US007655076B2

(12) United States Patent
Griffiths et al.

(10) Patent No.: US 7,655,076 B2
(45) Date of Patent: Feb. 2, 2010

(54) DEVICE FOR AIR CLEANING

(75) Inventors: George Griffiths, Skelmersdale (GB); Geoffrey Norman Walter Gay, Skelmersdale (GB)

(73) Assignee: Darwin Technology International Limited, Skelmersdale, Lancashire (GB)

( * ) Notice: Subject to any disclaimer, the term of this patent is extended or adjusted under 35 U.S.C. 154(b) by 120 days.

(21) Appl. No.: 11/578,819

(22) PCT Filed: Apr. 21, 2005

(86) PCT No.: PCT/GB2005/001534

§ 371 (c)(1),
(2), (4) Date: Jul. 30, 2007

(87) PCT Pub. No.: WO2005/102534

PCT Pub. Date: Nov. 3, 2005

(65) Prior Publication Data

US 2008/0034973 A1 Feb. 14, 2008

(30) Foreign Application Priority Data

Apr. 22, 2004 (GB) ..... 0408910.8

(51) Int. Cl.
*B03C 3/011* (2006.01)

(52) U.S. Cl. ..... 96/64; 96/66; 96/67; 96/97; 96/98

(58) Field of Classification Search ..... 96/66, 96/67, 83, 95, 97, 57, 58, 60, 62, 64, 77, 96/98–100

See application file for complete search history.

(56) References Cited

U.S. PATENT DOCUMENTS

| | | | | | |
|---|---|---|---|---|---|
| 2,908,348 | A * | 10/1959 | Rivers et al. | ..... | 96/67 |
| 2,974,747 | A * | 3/1961 | Coolidge, Jr. et al. | ..... | 96/69 |
| 4,234,324 | A * | 11/1980 | Dodge, Jr. | ..... | 96/99 |
| 4,477,268 | A * | 10/1984 | Kalt | ..... | 96/99 |
| 4,602,921 | A | 7/1986 | Shinohara et al. | | |
| 4,715,870 | A * | 12/1987 | Masuda et al. | ..... | 96/67 |
| 5,456,741 | A * | 10/1995 | Takahara et al. | ..... | 96/22 |
| 5,993,521 | A * | 11/1999 | Loreth et al. | ..... | 96/69 |
| 6,364,935 | B1 * | 4/2002 | Wennerstrom | ..... | 95/57 |
| 6,506,238 | B1 * | 1/2003 | Endo | ..... | 96/79 |
| 6,749,669 | B1 * | 6/2004 | Griffiths et al. | ..... | 96/67 |
| 6,790,259 | B2 * | 9/2004 | Rittri et al. | ..... | 95/78 |
| 6,858,064 | B2 * | 2/2005 | Bologa et al. | ..... | 95/65 |
| 7,014,688 | B2 * | 3/2006 | Griffiths et al. | ..... | 96/67 |
| 2004/0226448 | A1 * | 11/2004 | Griffiths et al. | ..... | 96/67 |

FOREIGN PATENT DOCUMENTS

| | | | |
|---|---|---|---|
| DE | 102 44 051 | C1 | 11/2003 |
| EP | 0 770 766 | A | 5/1997 |
| FR | 1 037 701 | A | 9/1953 |
| GB | 841 846 | A | 7/1960 |
| GB | 1 082 234 | A | 9/1967 |
| GB | 1086819 | | 11/1967 |
| GB | 2 352 658 | A | 2/2001 |

* cited by examiner

*Primary Examiner*—Richard L Chiesa
(74) *Attorney, Agent, or Firm*—Drinker Biddle & Reath, LLP

(57) ABSTRACT

Air cleaning device has a particle charging zone comprising a conducting sheet having a plurality of apertures, through which air can be passed, and a plurality of corona emitters each associated with an aperture, and a filter.

35 Claims, 6 Drawing Sheets

— Prior Art —

-- Prior Art --

DEVICE FOR AIR CLEANING

This Application is the U.S. National Phase Application of PCT International Application No PCT/GB05/01534 filed Apr. 21, 2005.

The invention relates to improvements in and relating to air cleaning devices.

A common method of cleaning particulate matter from the air is to pass the air through a particle charging array of corona wires and grounded plates and subsequently precipitate the charged particles in an electric field, typically onto an array of metal plates arranged alternatively at high and ground potential. This type of device is generally called an electrostatic precipitator.

There are a number of disadvantages associated with conventional electrostatic precipitators. For high efficiency the corona charging wires have to be placed carefully and centrally to ensure uniform charging of particles. These wires quickly collect dirt on the surface of the wires reducing the corona charging current and producing a non-uniform corona resulting in reduced efficiencies. When the corona wires are cleaned, because of their fragile nature they are often bent or moved out of alignment. If operating correctly, the corona wires effect good initial charging along their length but not at their ends, where they have to be attached to a supporting framework. Air flowing past the ends of the wires is not effectively charged and this results in a reduction of overall efficiency. Also, for high efficiencies a relatively large current needs to be supplied to the corona wires resulting in high ozone levels and a costly power supply.

An object of the present invention is to provide an improved air cleaning device.

According to the invention there is provided an air cleaning device having a particle charging zone comprising a conducting sheet having a plurality of apertures, through which air can be passed, and a plurality of corona emitters each associated with an aperture, and a filter.

The apertures are preferably circular and each aperture preferably has a corona emitter associated therewith. Each emitter is preferably central of its aperture. The emitters are preferably supported on conductor rods. The emitters preferably have sharp points and may be in the form of pins preferably between 3 and 30 mm in length. Alternatively, the emitters may be in the form of triangular teeth.

The emitters may be positioned, so that their points are behind the conducting sheet. Alternatively, the emitters may have their points substantially in the same plane as the conducting sheet.

Any suitable filter may be used in air cleaning device of the invention. In one preferred embodiment the filter may be an electrostatic filter. In another preferred embodiment the filter may be is a fibrous media filter. In yet another preferred embodiment of the invention, the filter may be an electret filter. The electret filter preferably comprises an array of layers of fluted plastics sheet material.

In a farther preferred embodiment of the invention the filter may comprise an array of layers of fluted plastics sheet material with electrodes between the layers connected to a high voltage source. The electrodes are preferably of paper or formed using conductive ink.

The conducting sheet may comprise a metal plate. Additionally, an apertured plastics screen may be provided upstream of the conducting sheet. The plastics screen is preferably a relatively flat sheet with apertures in a size range of 1 to 10 mm. The apertures are preferably circular or rectangular. Alternatively, the plastics screen may have a three-dimensional structure, such as a grill.

In an alternative preferred embodiment of the invention, the conducting sheet may comprise a plastics grill having its internal face coated with conductive material except in regions associated with corona emitters. Those regions are preferably circular.

In yet another preferred embodiment of the invention, the conducting sheet may comprise a metal grill having its internal face coated with non-conductive material except in regions associated with corona emitters. The metal grill may be in the form of a wire mesh. The non-conductive material may be a paint or of plastics. The coated regions of the metal grill are preferably circular.

It may be advantageous to include in devices of the invention a pre-filter. The pre-filter may be positioned before the charging zone or may be positioned between the charging zone and the filter. A preferred pre-filter may be made of reticulated open-cell polymeric foam preferably of the polyester type, in the size range 10 to 80 pores per linear inch (ppi), more preferably 30-60 ppi. Preferably the pre-filter is between 3 mm and 25 mm in depth depending on the particular application needs.

This invention will now be further described, by way of example only, with reference to the accompanying drawings, in which.

Figure 1:
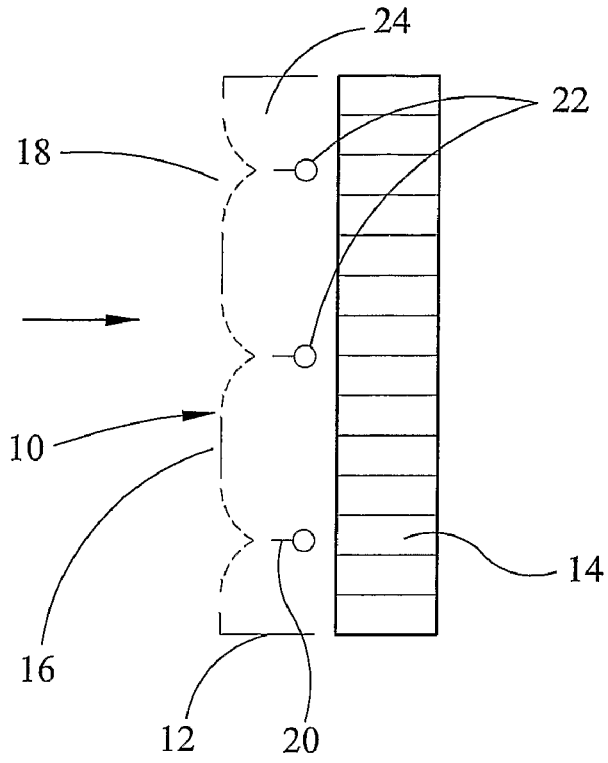
FIG. 1 is a section through a field charger and filter of a first embodiment of the invention.
Figure 2:
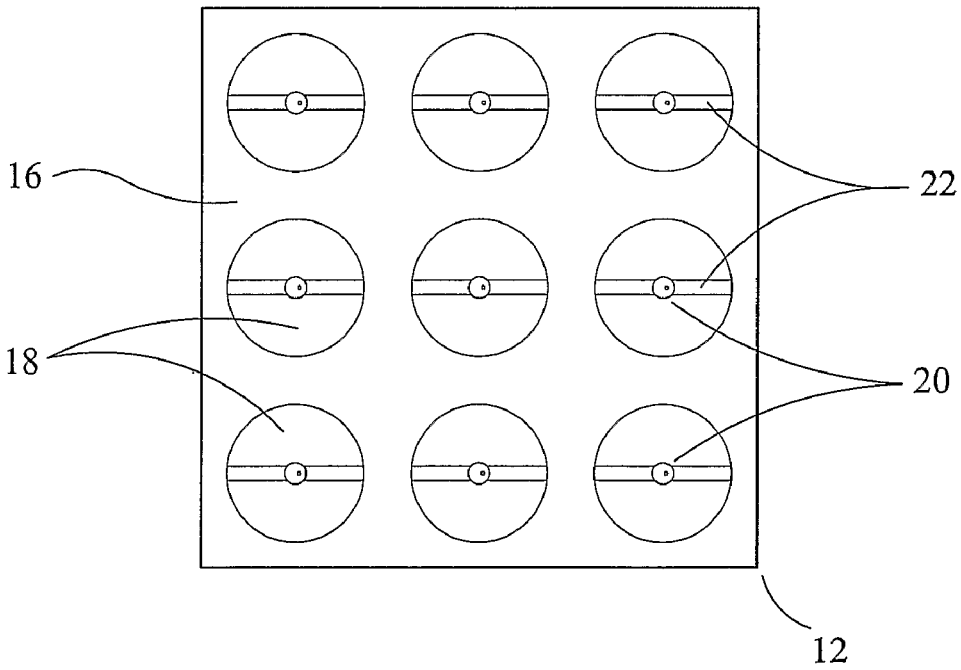
FIG. 2 is a plan view of the field charger of FIG. 1 with the air flowing as if into the plane of the paper away from the viewer.

Referring to FIGS. 1 and 2 of the accompanying drawings, an air cleaning device 10 comprises a particle charging zone 12 and a filter 14. The particle charging zone 12 comprises a grounded conductive sheet 16 having apertures 18, through which air is drawn or blown in the direction of the arrow.

Behind each circular aperture 18 is situated a centrally placed corona emitter pin 20 supported on a conducting rod 22 at high voltage with respect to the conductive sheet 16 which is usually at ground potential. A stream of air ions 24 (shown as dotted lines) generated by the emitter pins 20 moves under the influence of the electric field to the conductive sheet 16. The ions 24 spread out in a cone-like distribution from the tips of the emitter pins 20 and they are substantially all deposited on the conductive sheet 16 and more particularly in the vicinity of the circumference around each circular aperture 18.

The combination of particle charging zone 12, corona emitter pins 20 and conducting rods 22 is referred to as a field charger, in that corona emission and particle charging is effected within a controlled electric field.

The device 10 is designed such that all air entering has to pass through the circular apertures 18 of the conductive sheet 16. Particles suspended in the air stream have to move through the cone of high velocity air ions 24 issuing from each corona emitter pin 20. The fast moving air ions 24 collide with the suspended particles and charge them electrically.

The charged particles suspended in the air stream then enter the filter 14, where they are captured by electrostatic forces and effectively removed from the air stream. A suitable filter 14 could be the metal plates of an electrostatic precipitator or a fibrous media filter or a filter made of electret material. However, a preferred filter is as described in GB 2352658 using an array of fluted plastic sheet material with concealed electrodes. An advantage of such a combination of charging zone and filter is that very high efficiencies can be achieved at low pressure drop and low corona current.

All air ions generated for particle charging are produced in the corona of the emitter pins. This high velocity air ion stream issuing from each pin ensures that the pin remains substantially clean by virtue of it being capable of blowing away large particles, which may otherwise have collided with the pin tip to stop or reduce corona emission.

Figure 3:
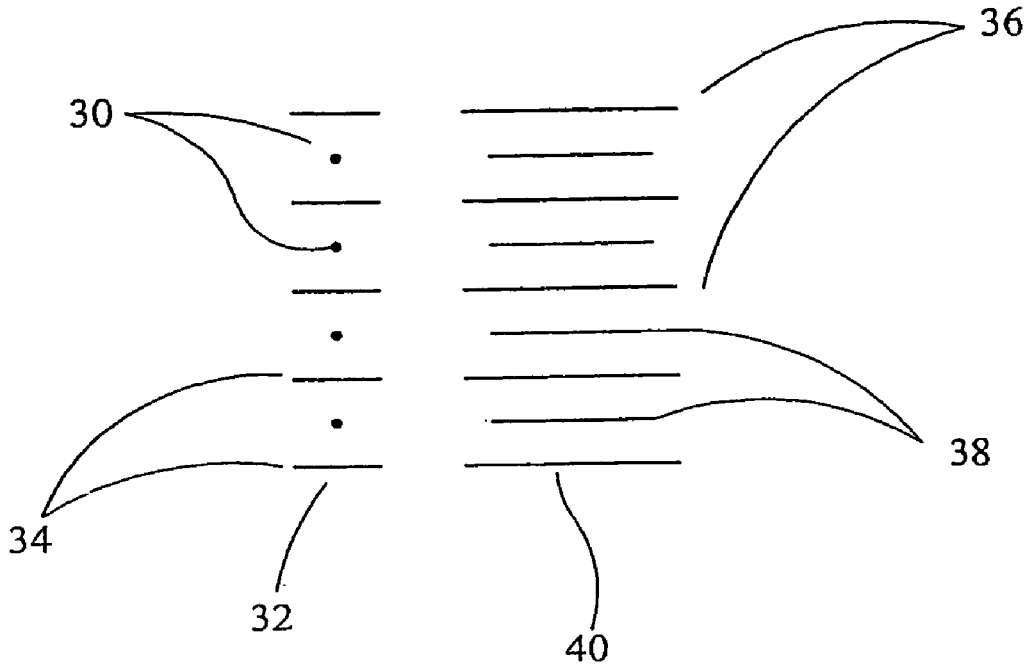
FIG. 3 is a section through the corona wire field charger and precipitator; of a conventional electrostatic precipitator.
Figure 4:
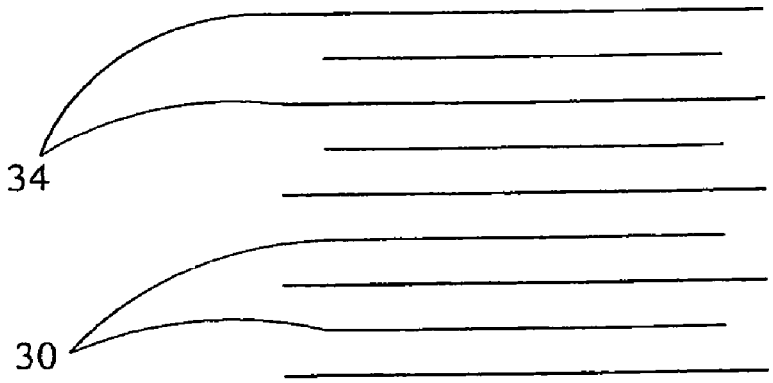
FIG. 4 is a plan view of the electrostatic precipitator of FIG. 3 with the air flowing as if into the plane of the paper away from the viewer.

By contrast, in conventional electrostatic precipitators, as shown in FIGS. 3 and 4 of the accompanying drawings, corona emission takes place along the length of corona wires 30. This represents a much larger exposed area than pin tips for collecting large particles of dust, which would then inhibit corona discharge. Laboratory tests indicate a significant reduction in corona current and hence effectiveness over only a few days. Also the velocity of the ion 'wind' along the length of the corona wires 30 is much less than in the case of a corona emitter pin. These combined factors require that an electrostatic air cleaner with corona charging wires needs more frequent cleaning to maintain high efficiency charging of particles.

Another disadvantage of conventional electrostatic precipitators as mentioned previously is that the corona wires 30 are relatively fragile and easily bent or moved out of alignment when they are cleaned thus leading to loss of efficiency. To ensure consistent high efficiency the corona wires 30 of the corona wire field charger 32 must be held central and parallel to the two adjacent ground plates 34. A further disadvantage is that corona discharge does not take place effectively at the ends of the corona wires 10 where they have to be attached to but insulated from the supporting framework, again leading to loss of efficiency.

A further disadvantage of conventional electrostatic precipitators is that a large separation distance is required between ground collector plates 36 and high voltage plates 38 of precipitator section 40 to prevent electrical breakdown between the plates. Typically maximum allowable field strength is 500 volts per millimeter. By contrast an electrostatic filter built according to GB 2352658 can achieve a working field strength of 5000 volts per millimeter without any danger of electrical breakdown. This ten-fold increase in field strength can be used to achieve much higher filtration efficiency or a much thinner filter.

By contrast, in the embodiment of the FIGS. 1 and 2 of the drawings, all of the air enters the charging zone 12 by passing through the circular holes 18. The symmetry of this arrangement ensures charging of all of the particles in the air stream passing through the field charger resulting in a higher efficiency of capture. Also the velocity of air ions emitted from the corona emitter pins 20 is so high that large dirt particles are blown away from the pin tip and do not stick to cause build up of dirt on the pin tips. This results in the need for less frequent cleaning.

Figure 5:
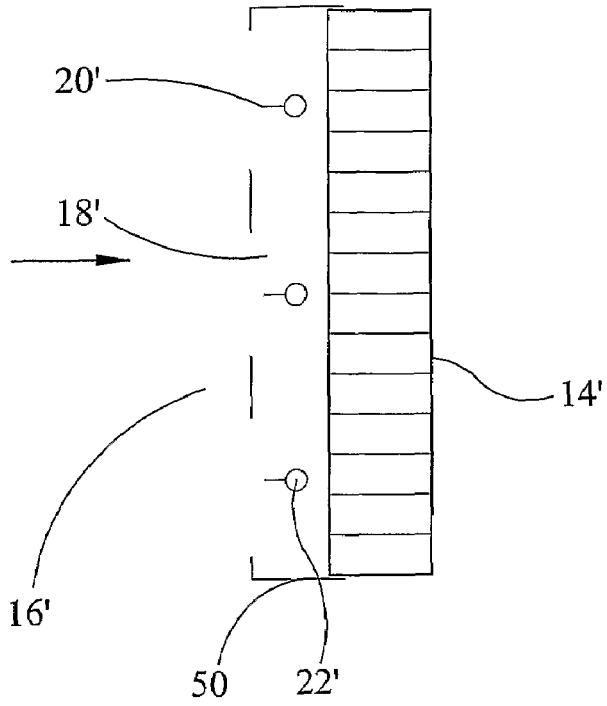
FIG. 5 is a section through a less deep field charger and filters of a second embodiment of the invention.

Turning to FIG. 5 of the accompanying drawings, a second embodiment of the present invention has a charging zone 50 of less depth than in the embodiment of FIGS. 1 and 2 and similar after 14'. The ion emitter pins —20'— on conducting rods —22'— have their sharp points in the same plane as the circular apertures of the conductive sheet —16'—. With this arrangement the ion emission current is maximum for any given voltage applied to the corona pins. The corona pins in the embodiment described are usually sharp pins of length between 3 mm and 30 mm but corona emission can be achieved using any sharp conductive points such as saw-type triangular teeth. Examination of the flow of ion current with this arrangement shows that current flows simultaneously to both the outside and inside of the circular apertures —18'—of the conductive sheet —16'—.

Figure 6:
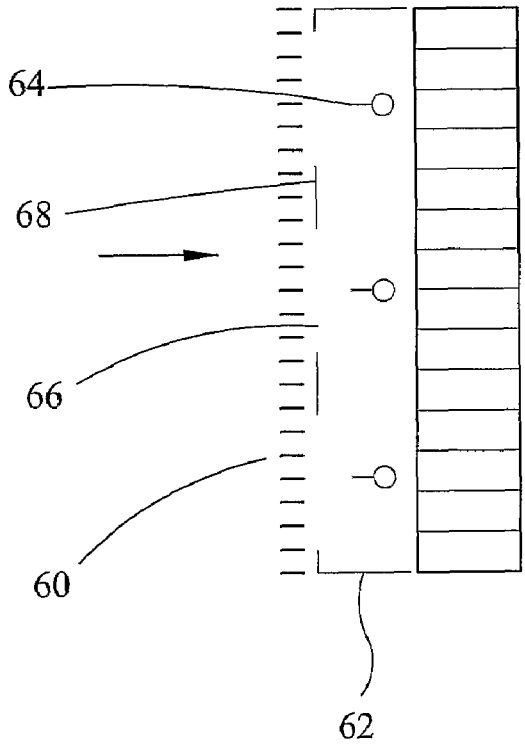
FIG. 6 is a section through a field charger and filter with a plastic screen or grill in front of the field charger of a third embodiment of the invention.

A third embodiment of the present invention is shown in FIG. 6 of the drawings. A plastics screen or grill or grid or mesh 60 is placed upstream and in close proximity to charging zone 62. This plastics screen 60 is essentially open to allow free flow of air and protective to prevent electric shock. The plastics screen may be made of a range of plastics materials provided that they are not conductive. The screen can be either a relatively flat plastics sheet with circular or rectangular holes in a size range of about 1 mm to 10 mm or it can have a substantially three dimensional structure. The placing of a plastics screen in close proximity to the holes influences the ion emission strongly. For a given voltage on emitter pins 64 the current is reduced in comparison with an embodiment in which there is no plastic screen. To optimise conditions for this arrangement the voltage on the pins may be increased to increase the ion emission current which flows substantially to the inside of circular holes 66 of the conductive sheet 68.

Figure 7:
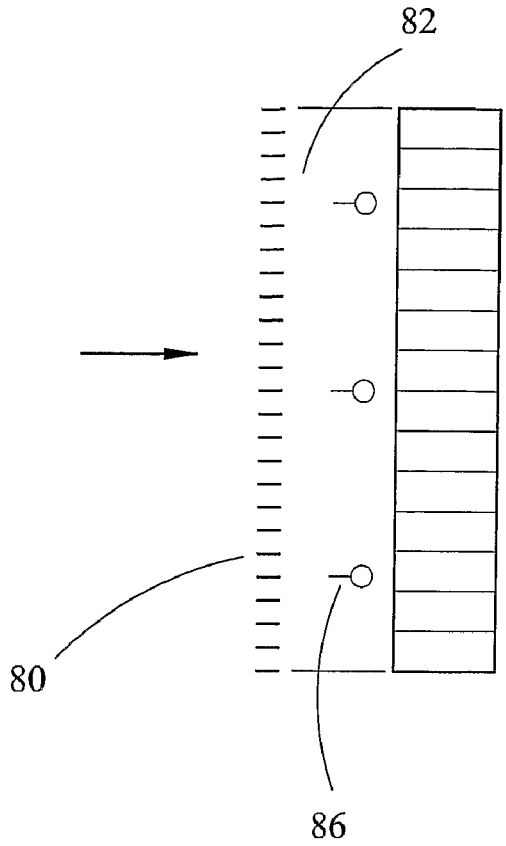
FIGS. 7 and 8 show a fourth embodiment of the invention using a plastics grill to replace the conductive sheet of the embodiment of FIGS. 1 and 2.
Figure 8:
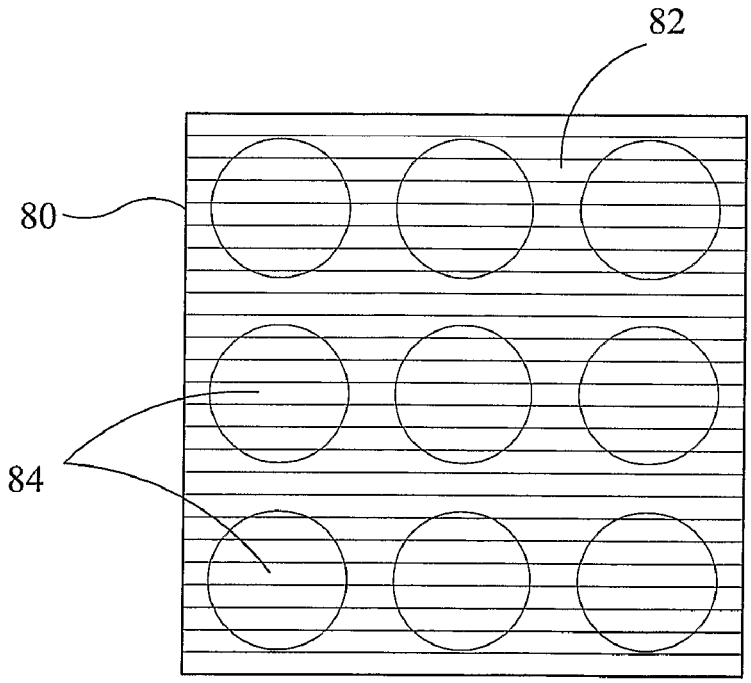

FIGS. 7 and 8 of the accompanying drawings describe a fourth embodiment which has a plastics grill 80 replacing the conductive sheet of the charging zone of the embodiment shown in FIG. 1. The plastics grill 80 has an internal face 82 covered with a conductive coating excepting for circular regions 84, which correspond to the positioning of ion emitters 86. The circular regions 84 free of conductive coating ensure that the ions spread out to the conductive coated regions. This arrangement has the benefit of lower resistance to airflow.

An alternative to the fourth embodiment uses a conductive metal grill, for example wire mesh, that has circular areas of non-conducting plastic or paint screen printed on its internal face, which correspond to the positioning of the ion emitters, these circular regions free of conductivity ensure that the ions spread out to the conductive coated regions.

The embodiments described have been with reference to circular apertures. However other aperture shapes including square, rectangular, elliptical and hexagonal apertures may effectively be utilised.

Alternative methods of adjusting ion emission current which can be applied to all the embodiments of the invention include changing the length of the emitter pins, changing the distance from the emitter pin tips to the plane of the apertures, changing the aperture size (a range of hole sizes from 20 mm to 70 mm has been tested), changing the applied voltage to the emitter pins and changing the depth of the field charger.

The first and second illustrated embodiments as shown in FIGS. 1 and 4 may be modified by using square or rectangular apertures in the conductive sheet with the corona emitter pin 20 placed centrally with respect to the square or rectangular apertures. These apertures can be created by various means including cutting or punching sheet metal, by forming a grid of rods or, as is possible with all of the other embodiments, by forming them in conductive plastic. In applications where a very low pressure drop is required the ratio of the open area of the square or rectangular apertures to the total area of the conductive sheet is maximised.

Another embodiment of the present invention uses hexagonal apertures in the conductive sheet and is similar in all other aspects to the embodiments of FIGS. 1 and 4, in that the corona emitter pin 20 is placed centrally with respect to each hexagonal aperture.

A comparison of performance characteristics using four different field charger designs will now be described with reference to Tables 1 & 2, and Chart 1.

A common filter (T464) was used in conjunction with each different field charger. The airflow was controlled at a face velocity of 2.5 meters per second. A test aerosol was generated using sodium chloride particles. The efficiency was determined using a particle counter (Lighthouse Handheld Model 3016) measuring 0.3 micron size particles upstream and downstream of the air cleaning device.

The filter (T464) was an electrostatic filter built according to GB 2352658 with a depth of 25 mm, a carbon ink electrode width of 10 mm, a flute height of 1.5 mm and operating at a potential of 8 kilovolts.

A conventional wire and plate field charger 32 (see Table 1 & FIG. 3) was constructed using tungsten corona wires 30 of 0.2 mm diameter fitted centrally between metal plates 34 set apart by 22 mm. The depth of the plates was 11 mm.

Square, circular and hexagonal aperture field chargers (see Table 1 & FIG. 1) were provided with corona emitter pins 20 of length 10 mm and diameter 0.6 mm supported on steel conducting rods 22 of 3 mm diameter.

TABLE 1

| Field charger type | Effective size | Depth | No. of apertures | Aperture size |
|---|---|---|---|---|
| Square grid | 200 × 200 mm | 17 mm | 16 | 43 |
| Circular hole | 200 × 200 mm | 13 mm | 16 | 42 |
| Conventional wire/plate | 200 × 200 mm | 11 mm | n/a | n/a |
| Hexagonal | 200 × 200 mm | 16 mm | 33 | 40 |
| Filter type | | | | |
| Filter T464 | 200 × 200 mm | 25 mm | n/a | n/a |

The test results in Table 2 show filtration efficiencies using circular apertures, square grid apertures, hexagonal apertures and a conventional corona wire and plate field charger.

Figure 9:
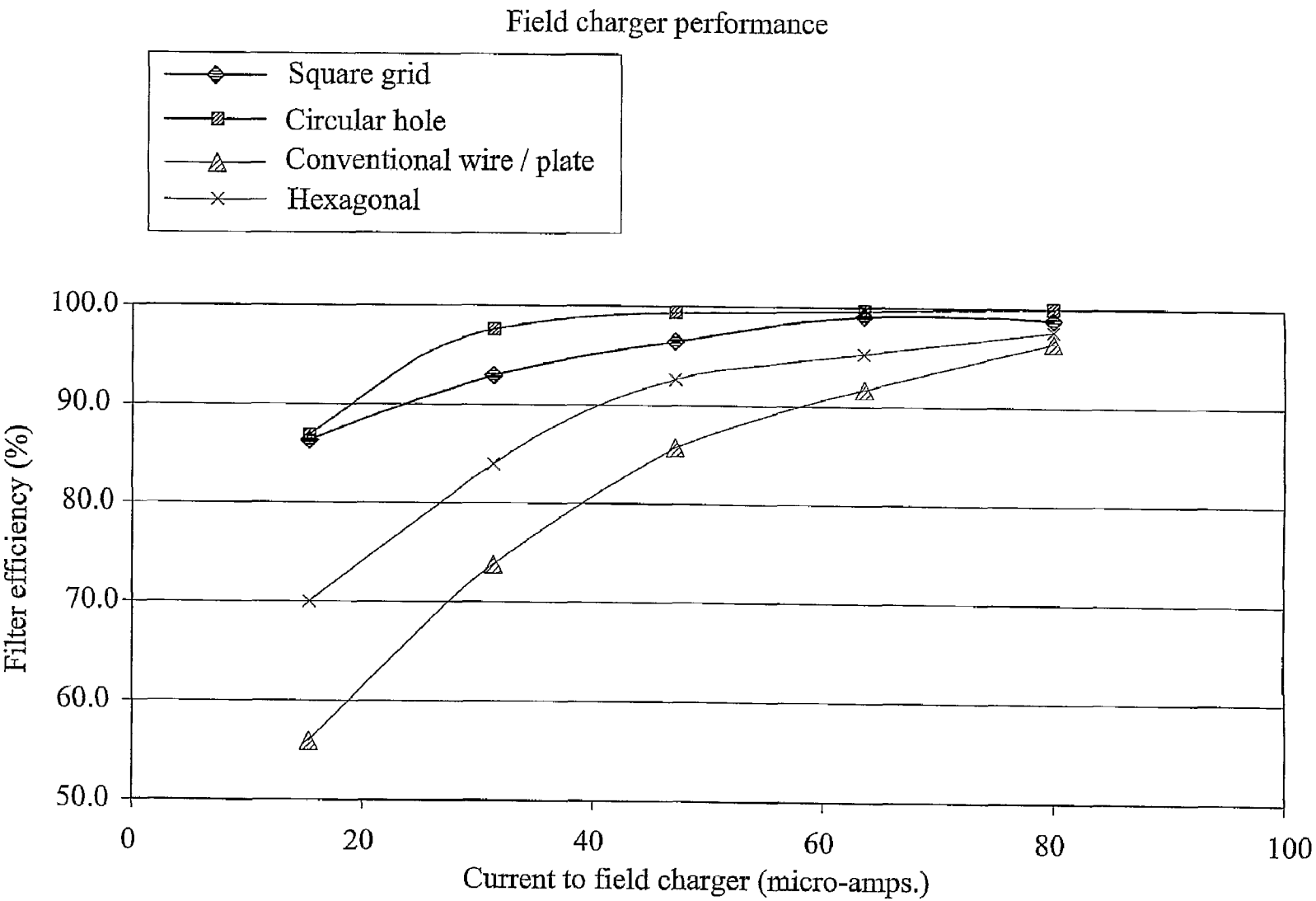
FIG. 9 is a plot of field charger performance.

Efficiencies were determined at increasing corona currents for each of the field chargers as shown in Table 2 and as plotted in FIG. 9 of the drawings.

TABLE 2

| Filtration efficiency (%) using various field chargers | | | | |
|---|---|---|---|---|
| Corona current (micro-amperes) | Square grid (%) | Circular hole % | Conventional wire/plate % | Hexagonal % |
| 16 | 85.9 | 86.4 | 55.8 | 83.5 |
| 32 | 92.5 | 96.9 | 73.6 | 94.9 |
| 48 | 95.9 | 99.3 | 85.6 | 97.6 |
| 64 | 98.2 | 99.6 | 91.4 | 99.6 |
| 80 | 98.4 | 99.9 | 95.8 | 99.8 |

It can be seen that the highest efficiency per microampere of corona current was achieved with the circular aperture field charger. Lower efficiencies were achieved with the square grid hexagonal apertures and the lowest efficiency of all was achieved using the conventional corona wire and plate field charger.

A further improvement relating to an increase in filtration efficiencies in those applications, where a heavy loading of dust is expected, can be achieved by using a combination of pre-filter, field charger, and electrostatic main filter.

Pre-filters are commonly used in combination with conventional media filters to provide a means for capturing larger particles and fibres and allowing the main media filter to capture smaller particles. Without a pre-filter the main media filter captures both large and small particles resulting in a rapid rise in pressure drop across the filter and thus shortening the life of the filter. When the pressure drop of a commercial media filter exceeds a certain value (often about 250 pascals) the filter is removed and replaced with a new filter. If it is left in place then airflow rates are reduced, power to the fan motor increases and the energy efficiency ratio of any air conditioning equipment in the air-stream is markedly reduced.

With a pre-filter in place to capture large particles the combined pre-filter and main filter takes longer to reach the end-of-life pressure value. In this application the use of a pre-filter has no significant impact on the efficiency of filtration as it becomes loaded with dust.

However, it is remarkable that provision of a suitable pre-filter with a combined field charger and electrostatic filter can produce a marked improvement in efficiency in a heavily loaded filter system.

Figure 10:
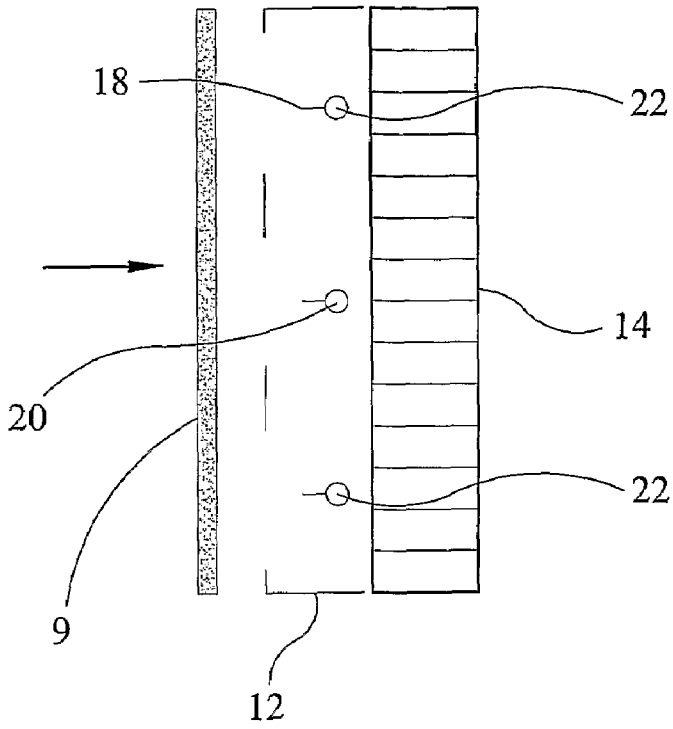
FIG. 10 shows another embodiment of the invention.

FIG. 10 of the accompanying drawings shows the position of a pre-filter 9 upstream of the field charger and electrostatic filter combination. Like parts to those in FIG. 1 of the drawings have been given the same reference numbers. The pre-filter is preferably constructed using reticulated open-cell polymeric foam preferably of the polyester type, in the size range 10 to 80 pores per linear inch (ppi), more preferably 30-60 ppi. Preferably the pre-filter is between 3 mm and 25 mm in depth depending on the particular application needs.

Figure 11:
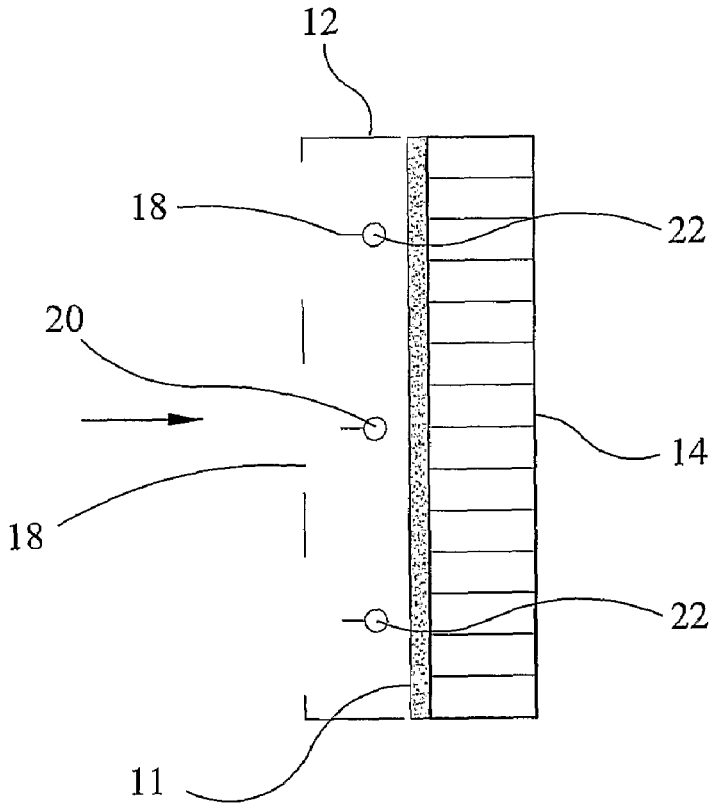
FIG. 11 shows a variation of the embodiment of FIG. 10.

FIG. 11 of the drawings shows a variation on the embodiment of FIG. 10, in which the pre-filter 11 is sandwiched between the field charger and the electrostatic filter. This arrangement allows some space saving and so is applicable in those situations where space is limited.

There now follows a description of tests, which illustrate the improvement of efficiency achieved with the use of an appropriate pre-filter.

Filtration efficiencies and pressure drops were first measured before and then also after loading with dust (see Table 3 & FIG. 11). In the first case no pre-filter was used and in the second case a 12 mm deep, 45 pores per inch pre-filter was placed immediately upstream of filter X581. The test dust utilised was ASHRAE 52:2 test dust and the loading amounted to an equivalent of 150 grams on a filter of size 24 inches by 24 inches. This represents a heavy dust loading. After the dust was loaded efficiency performance tests were carried out using a test aerosol of sodium chloride particles with measurement at the 0.3 micron particle size using a Lighthouse Handheld Model 3016 particle counter. The air flow was controlled at 2.5 meters per second filter face velocity for all tests.

TABLE 3

| | Efficiency before loading (%) | Efficiency after loading (%) | Pressure drop before loading (pascals) | Pressure drop after loading (pascals) |
|---|---|---|---|---|
| Without pre-filter | 98.7 | 36 | 35 | 45 |

TABLE 3-continued

| | Efficiency before loading (%) | Efficiency after loading (%) | Pressure drop before loading (pascals) | Pressure drop after loading (pascals) |
|---|---|---|---|---|
| With pre-filter | 98.6 | 97.9 | 58 | 98 |
| Filter X581 | Electostatic, 37 mm deep, 1.5 mm flutes, 8 kv | | | |
| Field charger type | Circular aperture with 5 micro-amps per pin | | | |
| Pre-filter type | Vitec RS45-FR, 12 mm deep, 35 ppi | | | |

The results in Table 3 show that without a pre-filter the efficiency drops from 98.7% to 36% after loading, whereas with a pre-filter the efficiency only dropped from 98.6% to 97.9% after loading.

Another advantage of this type of air cleaning device is that it is easily cleaned by vacuuming or washing and does not need to be replaced, as is the case with conventional media filters.

The invention claimed is:

1. An air cleaning device having a particle charging zone and a filter in series, wherein the particle charging zone comprises a conducting sheet having a plurality of apertures, through which air can be passed to the filter, and a plurality of corona emitters each associated with an aperture wherein the filter comprises an array of layers of fluted plastics sheet material with electrodes between the layers connected to a high voltage source.

2. An air cleaning device as claimed in claim 1, wherein the apertures are circular.

3. An air cleaning device as claimed in claim 1, wherein the apertures are square or rectangular.

4. An air cleaning device as claimed in claim 1, wherein the apertures are hexagonal.

5. An air cleaning device as claimed in claim 1, wherein each aperture has a corona emitter associated therewith.

6. An air cleaning device as claimed in claim 5, wherein each emitter is central of an aperture.

7. An air cleaning device as claimed in claim 1, wherein the emitters are supported on conductor rods.

8. An air cleaning device as claimed in claim 1, wherein the emitters are pins.

9. An air cleaning device as claimed in claim 8, wherein the pins are between 3 and 30 mm in length.

10. An air cleaning device as claimed in claim 1, wherein the emitters are triangular teeth.

11. An air cleaning device as claimed in claim 1, wherein the emitters have their points behind the conducting sheet.

12. An air cleaning device as claimed in claim 1, wherein the emitters have their points substantially in the same plane as the conducting sheet.

13. An air cleaning device as claimed in claim 1, wherein the filter is an electrostatic filter.

14. An air cleaning device as claimed in claim 1, wherein the filter is a fibrous media filter.

15. An air cleaning device as claimed in claim 1, wherein the filter is an electret filter.

16. An air cleaning device as claimed in claim 1, wherein the electrodes are of paper.

17. An air cleaning device as claimed in claim 1, wherein the conducting sheet comprises a metal plate.

18. An air cleaning device as claimed in claim 17 further comprising an apertured plastics screen upstream of the conducting plate.

19. An air cleaning device as claimed in claim 18, wherein the plastics screen is a relatively flat sheet with apertures in a size range of 1 to 10 mm.

20. An air cleaning device as claimed in claim 19, wherein the apertures are circular or rectangular.

21. An air cleaning device as claimed in claim 18, where the plastics screen has a three-dimensional structure.

22. An air cleaning device as claimed in claim 21, wherein the plastics screen is a mesh.

23. An air cleaning device as claimed in claim 1, wherein the conducting sheet comprises a plastics grill having its internal face coated with conductive material except in regions associated with corona emitters.

24. An air cleaning device as claimed in claim 23, wherein said regions are circular.

25. An air cleaning device as claimed in claim 1, wherein the conducting sheet comprises a metal grill having its internal face coated with non conductive material except in regions associated with corona emitters.

26. An air cleaning device as claimed in claim 25, wherein the metal grill is a wire mesh.

27. An air cleaning device as claimed in claim 25, wherein the non-conductive material is a paint or of plastics.

28. An air cleaning device as claimed in claim 25, wherein said regions are circular.

29. An air cleaning device as claimed in claim 1 including a pre-filter.

30. An air cleaning device as claimed in claim 29, wherein the pre-filter is before the charging zone.

31. An air cleaning device as claimed in claim 29, wherein the pre-filter is between the charging zone and the filter.

32. An air cleaning device as claimed in claim 29, wherein the pre-filter is of reticulated open-cell polymer foam.

33. An air cleaning device as claimed in claim 29, wherein the pre-filter has 10 to 80 pores per inch.

34. An air cleaning device as claimed in claim 33, wherein the pre-filter has 30 to 60 pores per inch.

35. An air cleaning device as claimed in claim 29, wherein the pre-filter is between 3 and 25 mm in depth.

* * * * *